US010781538B2

(12) United States Patent
Xu

(10) Patent No.: US 10,781,538 B2
(45) Date of Patent: Sep. 22, 2020

(54) YARN TWISTING DEVICE AND CONTINUOUS TWISTING METHOD

(71) Applicant: ZHEJIANG TIANZHU TEXTILE MACHINERY CO., LTD., Zhejiang (CN)

(72) Inventor: Zhibing Xu, Zhejiang (CN)

(73) Assignee: ZHEJIANG TIANZHU TEXTILE MACHINERY CO., LTD., Zhejiang (CN)

( * ) Notice: Subject to any disclaimer, the term of this patent is extended or adjusted under 35 U.S.C. 154(b) by 37 days.

(21) Appl. No.: 16/319,475

(22) PCT Filed: Jul. 28, 2017

(86) PCT No.: PCT/CN2017/094839
§ 371 (c)(1),
(2) Date: Jan. 22, 2019

(87) PCT Pub. No.: WO2018/019283
PCT Pub. Date: Feb. 1, 2018

(65) Prior Publication Data

US 2019/0292693 A1 Sep. 26, 2019

(30) Foreign Application Priority Data

Jul. 29, 2016 (CN) ..... 2016 1 0622001

(51) Int. Cl.
*D01H 7/86* (2006.01)

(52) U.S. Cl.
CPC ..... *D01H 7/86* (2013.01)

(58) Field of Classification Search
CPC ..... D01H 1/10; D01H 1/105; D01H 1/106; D01H 1/166; D01H 1/24; D01H 1/242;
(Continued)

(56) References Cited

U.S. PATENT DOCUMENTS 4,561,152 A * 12/1985 Niimi ..... D01H 5/82 19/236
4,569,192 A * 2/1986 Yamada ..... D01H 5/36 19/238
(Continued)

FOREIGN PATENT DOCUMENTS

CN 1147034 4/1997
CN 1234458 11/1999
(Continued)

OTHER PUBLICATIONS

"International Search Report (Form PCT/ISA/210)", dated Nov. 9, 2017, with English translation thereof, pp. 1-6.

*Primary Examiner* — Shaun R Hurley
(74) *Attorney, Agent, or Firm* — JCIPRNET

(57) ABSTRACT

A yarn twisting device includes a frame and following components on the frame: a hollow shaft, in which a passage is provided for a yarn passing therethrough; a drive mechanism configured to drive the hollow shaft for rotation; a winding mechanism driven by the hollow shaft for rotation to rewind the twisted yarn; a speed reducing mechanism for transmission coordination between the hollow shaft and winding mechanism. The twisting device is in simple structure and less twisting tension, which is available for continuous twisting of a single yarn and combined twisting of multiplied yarns.

9 Claims, 3 Drawing Sheets

(58) Field of Classification Search
CPC .. D01H 1/28; D01H 1/30; D01H 7/50; D01H 7/86; D01H 7/864
See application file for complete search history.

(56) References Cited

U.S. PATENT DOCUMENTS 4,703,431 A * 10/1987 Sako ..... D01H 5/42 19/240
5,085,045 A * 2/1992 Takeuchi ..... D01H 1/105 57/58.65
5,551,222 A * 9/1996 Kawarabashi ..... D01H 1/241 57/105
6,167,688 B1 * 1/2001 Umeoka ..... D01H 1/244 57/100

FOREIGN PATENT DOCUMENTS

| | | |
|---|---|---|
| CN | 1869296 | 11/2006 |
| CN | 101473077 | 7/2009 |
| CN | 202913125 | 5/2013 |
| CN | 203741487 | 7/2014 |
| CN | 105671707 | 6/2016 |
| CN | 106087144 | 11/2016 |
| EP | 0611841 | 8/1994 |

* cited by examiner

YARN TWISTING DEVICE AND CONTINUOUS TWISTING METHOD

CROSS-REFERENCE TO RELATED APPLICATION

This is a 371 application of the International PCT application serial no. PCT/CN2017/094839, filed on Jul. 28, 2017, which claims the priority benefits of China Application No. 201610622001.9 filed on Jul. 29, 2016. The entirety of each of the above-mentioned patent applications is hereby incorporated by reference herein and made a part of this specification.

BACKGROUND

Technical Field

The present invention is related to the textile field, in particular to a yarn twisting device and continuous twisting method.

Description of Related Art

Twisting treatment is essential for cotton fabric weaved with cotton yarn. Twisting aims to fix two or more single yarns into plied yarns so as to obtain such quality status as better shaping and high strength. Two or more single yarns will be lack of cohesion without twisting, which may split under an external force to the extent of affecting the quality of finished products.

Twisting is an essential approach to fabricate fiber strip into yarns. A twisted silk yarn is also known as PP fiber or thrown silk, which in general aims to endow the filament with twist. The twisted silk yarn is applicable to knitting and weaving, covering whole of the textile field. The twisted silk yarn above 150 D (15D-50D for superfine denier) is relegated into coarse yarn, which is in the unit of twist/cm. People regard twisted silk yarn of 80-500 twists as weak twist, 500-1000 twists as medium twist, and over 1000 twists as strong twist. According to fabric style, twisting is available in single Z twist or s and z in direction S and Z.

Twisting has following functions: enhance the strength and friction of the silk yarn to minimize fuzz and broken ends, and improve fastness of fabrics; provide certain profiles and patterns for the silk yarn; endow the fabrics with such effect as refraction, crinkle or looped pile and knit; enhance the elasticity of silk yarn, and improve wrinkle resistance (imitation memory ironing-free fabrics) and permeability (strong twist yarn), and make the fabrics cool and comfortable.

Two-for-one twister is a conventional twisting device, which has such disadvantages as complicated structure, high price and excessive tension on the yarn during twisting.

SUMMARY

In view of defects of the prior arts, the present invention aims to provide a yarn twisting device featuring in simple structure, less twisting tension and continuous twisting of a single yarn and combined twisting of multiplied yarns.

Technical solutions provided by the present invention are stated as follows:

A yarn twisting device, including a frame and following components on the frame:

a hollow shaft, in which a passage is provided for a yarn passing therethrough;

a drive mechanism, configured to drive the hollow shaft for rotation;

a winding mechanism, driven by the hollow shaft for rotation in the same direction to wind and twist the yarn; and a speed reducing mechanism for transmission coordination between the hollow shaft and the winding mechanism.

Preferably, A yarn twisting device including a frame and following components on the frame:

a hollow shaft, in which a passage is provided for a yarn passing therethrough;

a drive mechanism, configured to drive the hollow shaft for rotation at a first rotating speed;

a winding mechanism, driven by the hollow shaft for rotation in the same direction at a second rotating speed to wind and twist the yarn; and a speed reducing mechanism for transmission coordination between the hollow shaft and winding mechanism to reduce the input first rotating speed to the output second rotating speed.

In the present invention, it is applicable to configure the first rotating speed corresponding to the hollow shaft and the second rotating speed of winding mechanism according to actual number of yarns to be twisted and a twist of the yarn.

In a preferred embodiment, a twisting arm synchronous with the hollow shaft and extended outside of the winding mechanism is provided. The hollow shaft passes through a center portion of the twisting arm. A yarn guide mechanism is provided on one side of the twisting arm.

In a preferred embodiment, a through-hole connected with the passage is provided on a side wall of the hollow shaft. The yarn penetrating through the through-hole enters the winding mechanism through the yarn guide mechanism.

In a preferred embodiment, the yarn guide mechanism comprises a guide pulley on an end portion of the twisting arm and a guide sleeve located between the guide pulley and the through-hole.

In a preferred embodiment, the end portion of the twisting arm is connected with a guide plate extended to outside of a periphery of the winding mechanism. The guide plate is provided with a guide hole.

In a preferred embodiment, the drive mechanism comprises a twisting motor and a transmission part for linkage with the twisting motor and the hollow shaft.

In a preferred embodiment, the winding mechanism is a bobbin.

In a preferred embodiment, one end of the hollow shaft extends into the bobbin. The speed reducing mechanism comprises a drive gear sleeved on the hollow shaft and at least one speed change gear set engaged with the drive gear and having an axle fixed in correspondence with the frame. A gear tooth engaged with the speed change gear set is provided on an inner wall of the bobbin.

According to the present invention, a speed reducing mechanism with planetary gear is used in priority, which can be provided with three change gear sets around the hollow shaft.

In a preferred embodiment, the axle of the change gear set is installed with a first magnetic part. A mounting seat fixed to the frame is provided with the second magnetic part fitting with the first magnetic part.

In the present invention, the magnetic part is a device with magnetic performance, such as magnet. An axle of a speed change gear inside the speed reducing mechanism of a planetary gear is fixed through suction between the first magnetic part and the second magnetic part to ensure rotation of the speed change gear during operation without revolution around the hollow shaft, and the rotation of the speed change gear will drive rotation of the bobbin.

In a preferred embodiment, at least one locating gear engaged with the gear tooth is provided inside the bobbin. A revolving shaft of the locating gear is also installed with a magnetic part.

The present invention further provides a method for continuous twisting of a yarn, comprising:

the yarn to be twisted penetrates an axial passage inside a hollow shaft;

driven by the drive mechanism, the yarn rotates at a first rotating speed inside the hollow shaft; and the yarn being twisted is wound by a winding mechanism; the winding mechanism rotates in the same direction at a second rotating speed that is lower than the first rotating speed.

The present invention features in simple structure, less twisting tension, and continuous twisting of a single yarn and combined twisting of multiplied yarns.

DESCRIPTION OF THE EMBODIMENTS

Figure 1:
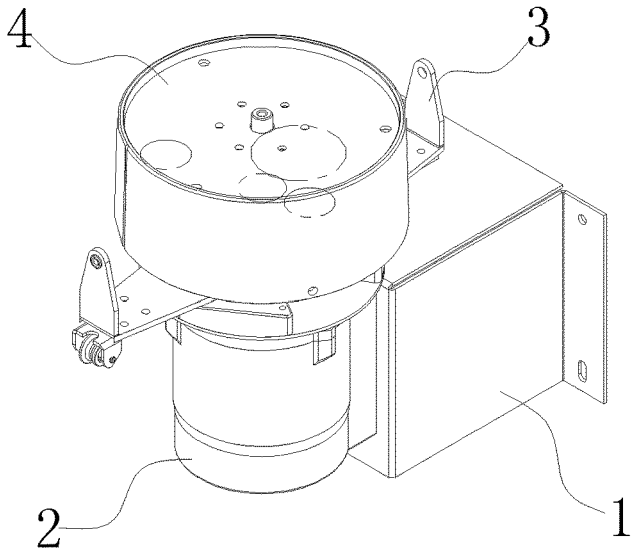
FIG. 1 is a structural diagram for a twisting device according to the present invention.
Figure 2:
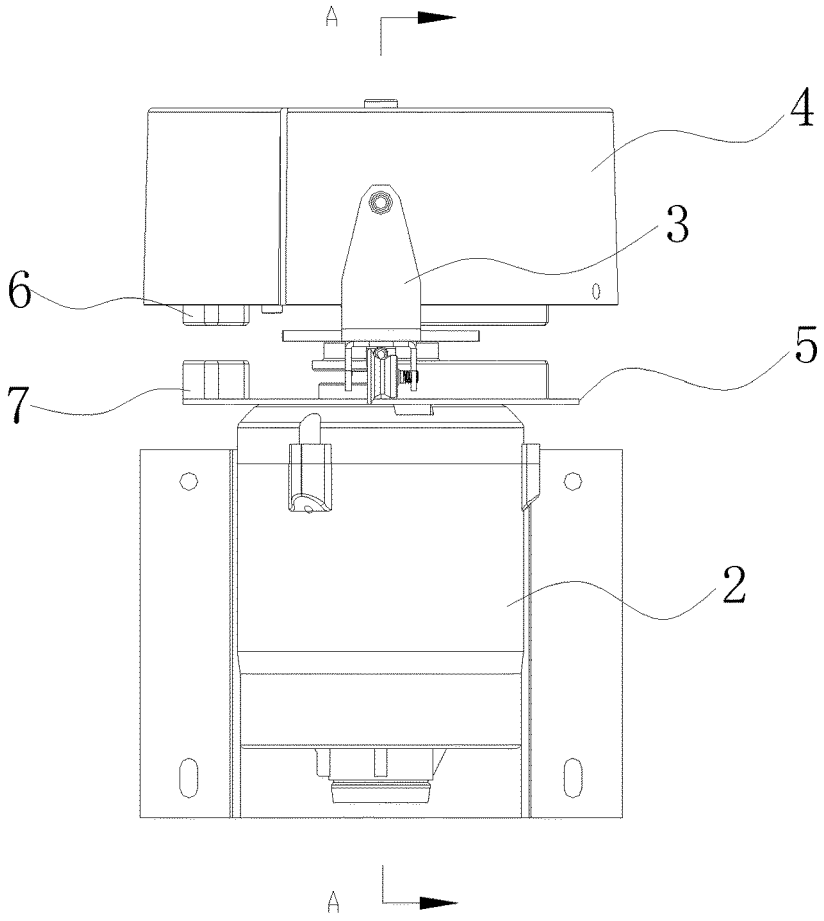
FIG. 2 is a perspective diagram of the twisting device.
Figure 3:
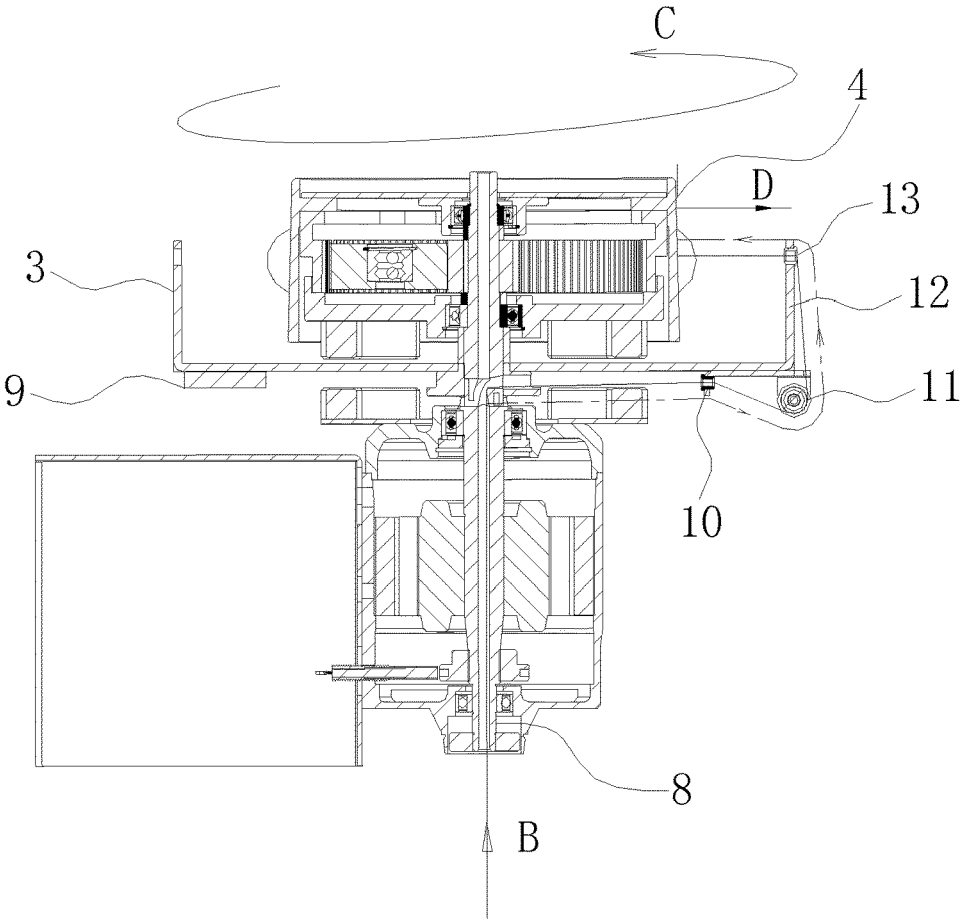
FIG. 3 is a sectional diagram taken along line A-A in FIG. 2.

The twisting device as shown in FIG. 1 to FIG. 3 comprises a frame, a hollow shaft 8 installed on the frame, a drive mechanism, a winding mechanism 4, and a speed reducing mechanism.

A passage for a yarn to pass therethough is provided inside the hollow shaft 8. An arrow B in FIG. 3 refers to a movement direction of the yarn. A single yarn or multiplied yarns directly enter the hollow shaft 8.

The drive mechanism comprises a twisting motor 2. The twisting motor 2 is fixed to the frame by a fastener 1. The twisting motor 2 drives the hollow motor shaft 8 to rotate at a first speed.

In this embodiment, a main shaft of the twisting motor 2 is as a same component with the hollow shaft 8; in other words, the main shaft of the twisting motor 2 and the hollow shaft 8 are coaxially arranged. Furthermore, the main shaft of the twisting motor 2 and the hollow shaft 8 can be provided on different axis to realize linkage between the twisting motor 2 and the hollow shaft 8 via a transmission part. The transmission part is, for example, a gear or a transmission belt, and so on.

A twisting arm 3 is provided at a center portion of the hollow shaft 8. The hollow shaft 8 passes through the center portion of the twisting arm 3. In this embodiment, the twisting arm 3 is fixed to the hollow shaft 8. The twisting arm 3 is to be in synchronous rotation while the hollow shaft 8 is rotating. An arrow C in FIG. 3 refers to a rotation direction of the twisting arm 3 and the hollow shaft 8.

A yarn guide mechanism is provided on one side of the twisting arm 3; whereas a counterbalance 9 is installed on the other side of the twisting arm 3, to keep both sides of the twisting arm 3 balanced during rotation.

A through-hole communicated with the passage thereof is further provided at the center portion of hollow shaft 8. The yarn penetrating the through-hole enters the winding mechanism 4 through the yarn guide mechanism for winding of the yarn.

In this embodiment, the yarn guide mechanism comprises a guide pulley 11 on an end portion of the twisting arm 3 and a guide sleeve 10 located between the guide pulley 11 and the through-hole. To ensure adequate tension on the yarn, the yarn passing through the through-hole and the guide pulley 11 is bent, and an inclination angle of the yarn between the through-hole and the guide sleeve 10 is smaller than that of the yarn between the guide sleeve 10 and the guide pulley 11.

In this embodiment, a guide plate 12 extended to outside of a periphery of the winding mechanism 4 is provided on the end portion of the twisting arm 3. The guide plate 12 is provided with a guide hole 13. The yarn passing through the guide pulley 11 enters the winding mechanism 4 from the guide hole 13 for winding of the yarn.

Figure 4:
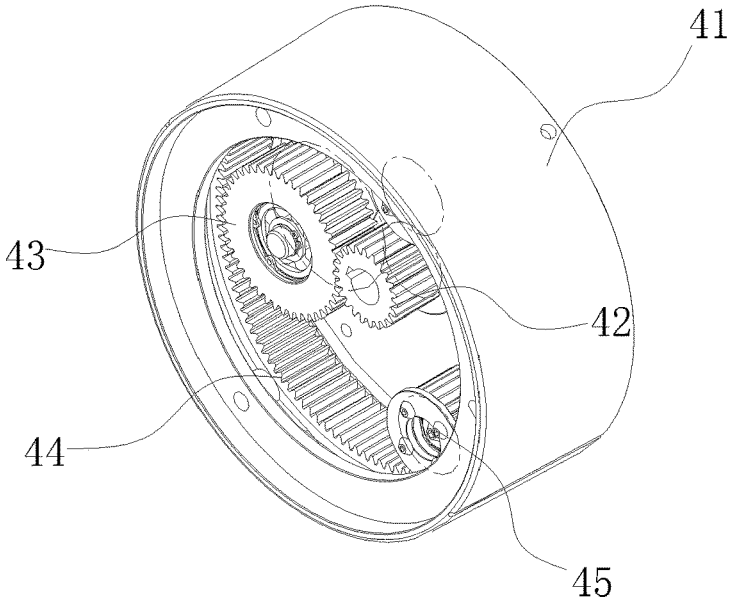
FIG. 4 is a structural diagram of a winding mechanism.
Figure 5:
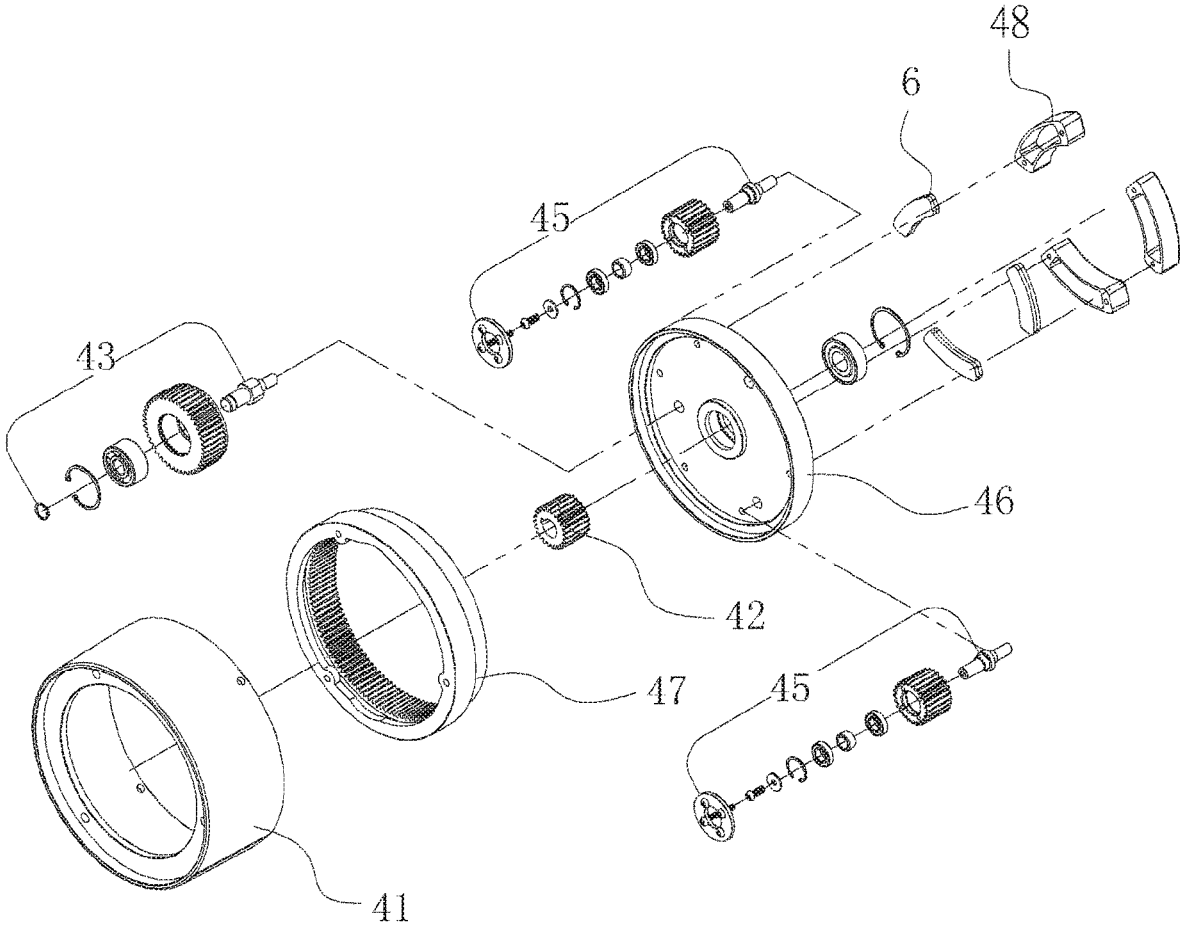
FIG. 5 is an exploded diagram of the winding mechanism in FIG. 4.

As shown in FIG. 4 and FIG. 5, winding mechanism 4 is driven by the hollow shaft 8 for synchronous rotation at the second rotating speed to wind and twist the yarn. With the transmission coordination between the hollow shaft 8 and the winding mechanism 4, the speed reducing mechanism is adapted to reduce the input first rotating speed to the output second rotating speed.

In this embodiment, the winding mechanism 4 comprises a bobbin 41. The speed reducing mechanism belongs to a gear reducing assembly. The speed reducing mechanism comprises a drive gear 42 inside the hollow shaft 8 and at least one speed change gear set 43 engaged with the drive gear 42 and having an axle fixed in correspondence with the frame. A gear tooth 44 engaged with the speed change gear set is provided on an inner wall of the bobbin 41.

One end of the hollow shaft 8 extends into the bobbin 41, which aims to reduce the first rotating speed of the hollow shaft 8 to the second rotating speed driving the bobbin 41 through the transmission coordination of the drive gear 42, the speed change gear set 43 and the gear tooth 44, so as to enable the bobbin 41 rotating at the second rotating speed to continuously wind the yarns being twisted. Furthermore, the bobbin 41 is also available for release of the yarn being wound under tractions of other mechanisms according to practical demands so as to realize continuous twisting in a direction indicated by an arrow D in FIG. 3.

In this embodiment, as the bobbin 41 is always kept in a rotating state, and the speed change gear set 43 is located at the bobbin 41, it is necessary to maintain a position of the speed change gear set 43 to realize gear transmission deceleration. For this reason, an axle of the speed change gear set 43 is installed with a first magnetic part 6. A mounting seat 5 fixed on the frame is provided with a second magnetic part 7 fitting with the first magnetic part 6. The first magnetic part 6 and the second magnetic part 7 are located on upper and lower sides of the twisting arm 3, which aim to keep the position of the axle of the speed change gear set 43 through mutual suction. Moreover, a lateral side of the bobbin 41 is provided with a cover 46. To better fix the first magnetic part 6, a magnetic guide seat 48 is used to fix the first magnetic part 6.

In this embodiment, the gear tooth 44 is provided on annular ring 47 that is fixed to the bobbin 41, and an internal part of the bobbin 41 is hollow. To prevent the bobbin 41 from shaking, at least one positioning gear 45 engaged with the gear tooth 44 is provided inside the bobbin 41. An end portion of a rotary shaft of the positioning gear 45 is also installed with a magnetic part that is fixed through magnetic suction.

What mentioned above are instances of preferred embodiments for the present invention, which are not intended to restrict the present invention; any alteration, equivalent substitution and improvement as made based on the spirit and principles of the present invention are to be under the protection of the present invention.

What is claimed is:

1. A yarn twisting device, comprising a frame and following components on the frame:

a hollow shaft, in which a passage is provided for a yarn passing therethrough;

a drive mechanism, configured to drive the hollow shaft for rotation;

a winding mechanism, driven by the hollow shaft for rotation in the same direction to wind and twist the yarn; and a speed reducing mechanism for transmission coordination between the hollow shaft and the winding mechanism, wherein the yarn twisting device is provided with a twisting arm extended outside of the winding mechanism for synchronous rotation with the hollow shaft; the hollow shaft passes through a center portion of the twisting arm; a yarn guide mechanism is provided on one side of the twisting arm.

2. The yarn twisting device according to claim 1, wherein a through-hole communicated with the passage is provided on a side wall of the hollow shaft; the yarn penetrating through the through-hole is guided toward the winding mechanism through the yarn guide mechanism.

3. The yarn twisting device according to claim 2, wherein the yarn guide mechanism comprises a guide pulley on an end portion of the twisting arm and a guide sleeve located between the guide pulley and the through-hole.

4. The yarn twisting device according to claim 3, wherein the end portion of the twisting arm is connected with a guide plate extended to outside of a periphery of the winding mechanism; the guide plate is provided with a guide hole.

5. The yarn twisting device according to claim 1, wherein the drive mechanism comprises a twisting motor and a transmission part for linkage with the twisting motor and the hollow shaft.

6. A yarn twisting device, comprising a frame and following components on the frame:

a hollow shaft, in which a passage is provided for a yarn passing therethrough;

a drive mechanism, configured to drive the hollow shaft for rotation;

a winding mechanism, driven by the hollow shaft for rotation in the same direction to wind and twist the yarn; and a speed reducing mechanism for transmission coordination between the hollow shaft and the winding mechanism, wherein the winding mechanism is a bobbin, one end of the hollow shaft extends into the bobbin; the speed reducing mechanism comprises a drive gear sleeved on the hollow shaft and at least one speed change gear set engaged with the drive gear and having an axle fixed in correspondence with the frame; a gear tooth engaged with the speed change gear set is provided on an inner wall of the bobbin.

7. The yarn twisting device according to claim 6, wherein the axle of the speed change gear set is installed with a first magnetic part, and a mounting seat fixed to the frame is provided with a second magnetic part fitting with the first magnetic part.

8. The yarn twisting device according to claim 7, wherein at least one locating gear engaged with the gear tooth is provided inside the bobbin; a revolving shaft of the locating gear is also installed with a magnetic part.

9. A method for continuous twisting of a yarn, the method comprising the yarn to be twisted penetrates an axial passage inside a hollow shaft;

driven by a drive mechanism, the yarn rotates at a first rotating speed inside the hollow shaft;

the yarn being twisted is wound by a winding mechanism; the winding mechanism rotates in the same direction at a second rotating speed that is lower than the first rotating speed, wherein the winding mechanism is a bobbin, one end of the hollow shaft extends into the bobbin; the speed reducing mechanism comprises a drive gear sleeved on the hollow shaft and at least one speed change gear set engaged with the drive gear and having an axle fixed in correspondence with the frame; a gear tooth engaged with the speed change gear set is provided on an inner wall of the bobbin.

* * * * *